United States Patent [19]

London et al.

[11] Patent Number: 4,836,804

[45] Date of Patent: Jun. 6, 1989

[54] ELECTRICAL CONNECTOR

[75] Inventors: Norman H. London, Rydal; Leonard S. Greene, Havertown; Lee J. Falgoust, Hatboro, all of Pa.

[73] Assignee: London Harness & Cable Corp., Philadelphia, Pa.

[21] Appl. No.: 197,865

[22] Filed: May 24, 1988

[51] Int. Cl.[4] ..... H01R 13/40

[52] U.S. Cl. ..... 439/598; 439/565; 439/557; 439/599

[58] Field of Search ..... 439/544, 545, 560, 567, 439/557, 569, 562, 565, 598, 599, 588, 589, 596

[56] References Cited

U.S. PATENT DOCUMENTS

| | | | |
|---|---|---|---|
| 1,956,409 | 4/1934 | Benander | 173/337 |
| 2,948,773 | 8/1960 | Hawes | 439/565 |
| 3,072,340 | 1/1963 | Dean | 339/49 |
| 3,144,292 | 8/1964 | Forney, Jr. | 339/128 |
| 3,824,524 | 7/1974 | Glover | 339/60 R |
| 3,903,458 | 9/1975 | Arnoux | 339/128 |
| 4,139,727 | 2/1979 | Kuballa | 339/210 M |
| 4,580,859 | 4/1986 | Frano et al. | 439/557 |
| 4,605,276 | 8/1986 | Hasircoglu | 439/599 |
| 4,662,699 | 5/1987 | Vachhani et al. | 439/557 |
| 4,707,045 | 11/1987 | Ney et al. | 439/271 |

FOREIGN PATENT DOCUMENTS 2167611 5/1985 United Kingdom .

*Primary Examiner*—P. Austin Bradley

*Attorney, Agent, or Firm*—Caesar, Rivise, Bernstein, Cohen & Pokotilow, Ltd.

[57] ABSTRACT

An electrical connector includes a plurality of contacts retained within a housing formed by an inner closure and an outer sleeve. The inner closure is formed of identical mating sections which are retained in a closed condition by the outer sleeve, and which, when separated from the outer sleeve, can be non-destructively opened to provided access to the electrical contacts.

8 Claims, 2 Drawing Sheets

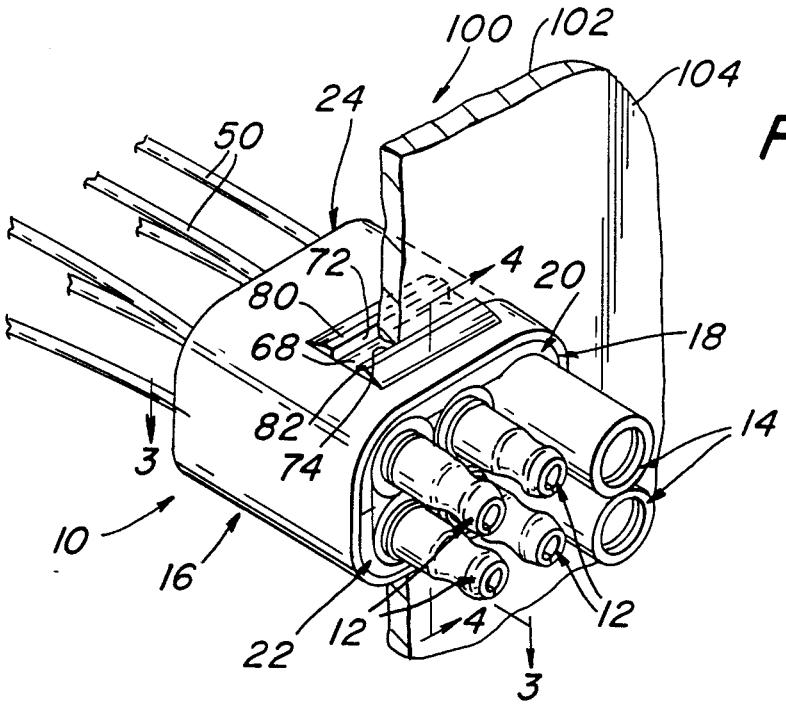
FIG. 1
FIG. 3
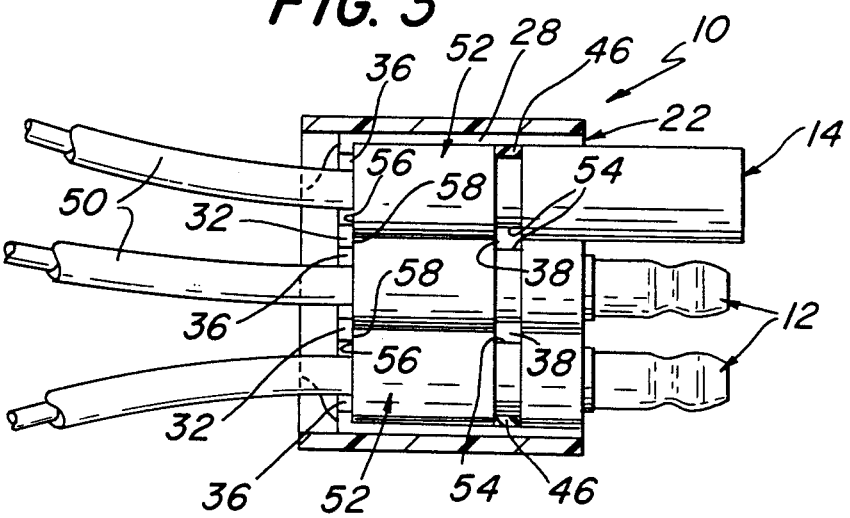

ELECTRICAL CONNECTOR

FIELD OF THE INVENTION

This invention relates generally to an electrical connector, and more specifically to an electrical connector which can be used in a variety of different environments, either attached to or separate from a mounting panel, and which can be non-destructively opened to permit repair or replacement of electrical contacts, as is desired or needed.

BACKGROUND ART

Electrical connectors including a plurality of electrical contacts retained within an insulating housing are well known in the prior art. It is quite common to assemble in each insulating housing a combination of both male contacts and female contacts in a predetermined array or pattern so that the connector can only be connected with a second connector having a mating or complimentary array of male and female contacts. This assures that a pair of electrical connectors are not improperly plugged together.

In the past it has been common to establish multiple pin and receptacle connections by utilizing molded plugs. These plugs, although still in use, have proven to be quite expensive to make and relatively heavy. Moreover, the molded housing cannot be easily separated or opened to permit the replacement or repair of contacts therein.

An improvement on the molded plug has been made, wherein a housing formed from a pair of identical mating sections are employed to hold a plurality of electrical contacts in place. In one such connector, manufactured by Dill Products, Inc. of Norristown, Pennsylvania, the housing sections include cammed tabs and slots for securing the housing sections together. Outer surfaces of the housing sections are provided with axially spaced-apart confronting surfaces to permit the panel mounting of the connector, such as is desired for use in an automobile or other vehicle.

The arrangement of cammed tabs and slots, as is provided for in the Dill connector, does not provide a very secure arrangement between the two halves of the housing. Therefore, unless the housing is maintained in its assembled condition by mounting the connector within a panel, there is a possibility that the housing sections could become separated during handling and/or use.

U.S. Pat. No. 1,956,409, issued to Benander, discloses a connector housing having opposed, channeled plastic body members 10 and 11, which are held together by opposed, generally C-shaped clips 30 and 31. The connector disclosed in the Benander '409 patent is not of the type which mounts the electrical contacts one over the other, and is not designed for use in a panel mounted system.

U.S. Pat. No. 3,144,292, issued to Forney, Jr., and U.S. Pat. No. 3,072,340, issued to Dean, disclose clip-type members positioned about the housing of a connector and including retaining members for permitting the connectors to be mounted on other devices. In the Forney, Jr. device the clip member is shown at 14 in FIG. 1, and in the Dean device the clip members are shown at 98 and 98*a* in FIGS. 10 and 12. The clip members of these patented devices are solely for the purpose of permitting the connector to be mounted to another device, and do not provide a retaining function for multiple sections of a connector housing.

United Kingdom Patent Application No. 2,167,611A discloses the use of a clip member 51 (FIG. 5) for use in mounting a connector housing to a separate device. Like the Forney, Jr. device and the Dean device discussed earlier, the clip member 51 is not employed to retain separate housing sections in an assembled condition.

U.S. Pat. Nos. 3,824,524 issued to Glover; 3,903,458, issued to Arnoux and 4,139,727, issued to Kuballa, disclose other arrangements for permitting a connector to be secured to a panel or other device.

OBJECTS OF THE INVENTION

It is a general object of this invention to provide an electrical connector which is inexpensive and easy to construct, and also reliable in operation.

It is a more specific object of this invention to provide an electrical connector which can be disassembled without damaging the connector, and, when assembled, is a secure system which will not separate in use, even when it is not panel-mounted.

It is a further object of this invention to provide a multi-contact electrical connector which can be reliably used in a number of environments, either attached to or separated from a panel.

SUMMARY OF THE INVENTION

The above and other objects of this invention are achieved in an electrical connector having a housing for a plurality of electrical contacts, wherein the housing includes an inner closure for receiving the contacts and an outer sleeve for surrounding the inner closure. The inner closure includes mating sections which have locating means thereon for permitting the sections to be engaged with each other in proper position for retaining the electrical contacts therebetween, and for permitting the mating sections to be non-destructive separated from each other so that the inner closure can be opened to expose the electrical contacts therein. The outer sleeve has a peripheral wall, at least a portion of which is continuous for defining a central passageway for receiving the inner closure therein to thereby retain the inner closure in a closed condition. The inner closure is removable from the outer sleeve for permitting the mating sections of the inner closure to be opened when desired or needed. Cooperating retaining means are provided on the outer sleeve and inner closure for retaining the inner closure in a predetermined location within the sleeve and for permitting the inner closure to be removed from the sleeve, when desired.

In accordance with a preferred aspect of this invention the outer surface of the sleeve is provided with axially spaced-apart surfaces unitarily formed with said sleeve for receiving a panel therebetween, whereby the connector can be secured to a panel member.

In accordance with a further preferred feature of this invention the cooperating retaining means for retaining the inner closure in a predetermined location within the outer sleeve includes a raised rib on the outer periphery of each section of the inner closure and an opening through an inner surface of the sleeve for receiving each of the ribs therein.

In the most preferred embodiment of this invention the openings through the inner surface of the outer sleeve for receiving raised ribs on the outer periphery of the mating sections of the inner closure extend through the peripheral wall of the sleeve, and spaced-apart edges defining each of the openings extend outwardly to provide confronting surfaces for receiving a panel therebetween.

BRIEF DESCRIPTION OF THE DRAWINGS

Other objects and many of the attendant advantages of this invention will be readily appreciated as the same becomes better understood by reference to the following detailed description when considered in connection with the accompanying drawings, wherein:

FIG. 1 is an isometric view of an electrical connector of this invention, with a panel in which the connector is mounted being shown in fragmentary view;

FIG. 3 is a sectional view taken along the line 3—3 of FIG. 1; and

DESCRIPTION OF THE PREFERRED EMBODIMENT OF THE INVENTION

Figure 2:
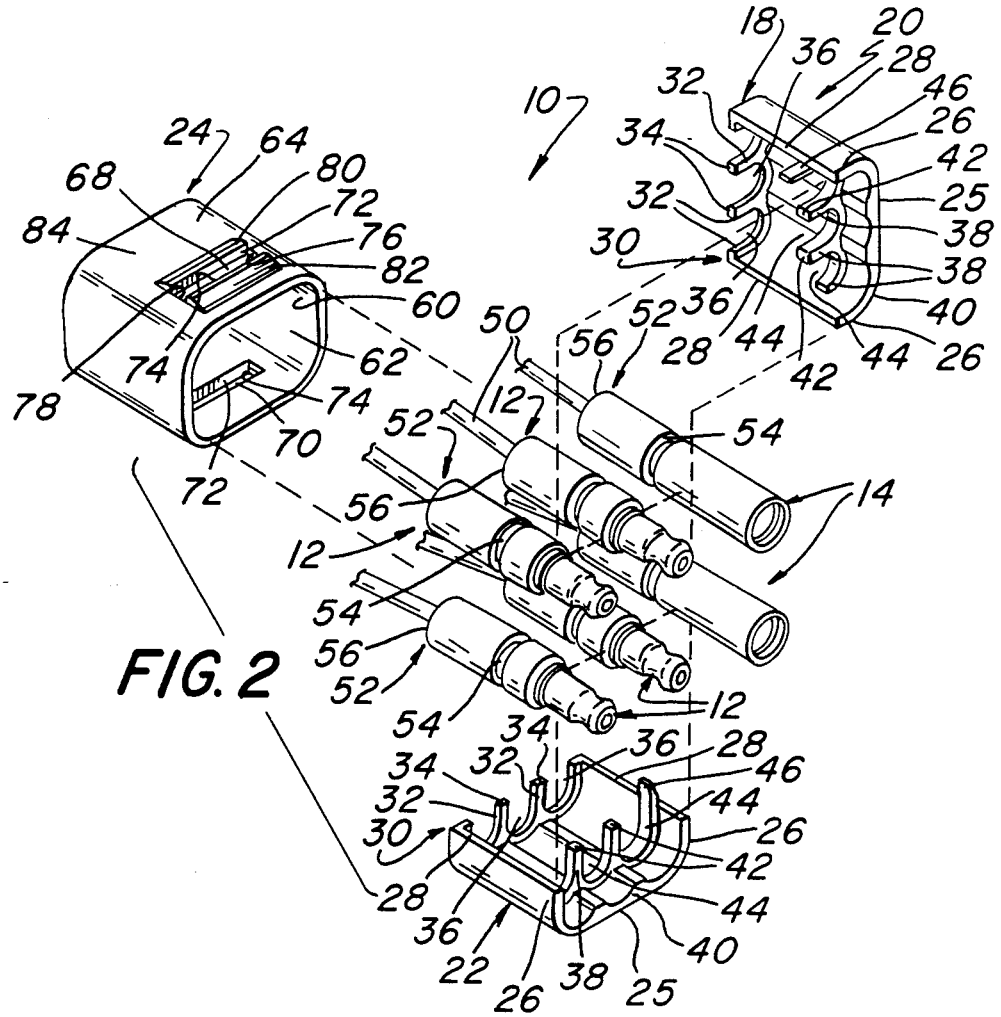
FIG. 2 is an exploded isometric view of the electrical connector of this invention.

Referring now in greater detail to the various figures of the drawings wherein like reference characters refer to like parts, an electrical connector embodying the present invention is generally shown at 10 in FIG. 1. The device 10 basically comprises a plurality of male contacts 12 and a plurality of female contacts 14 retained by a insulating housing 16. The insulating housing 16 in accordance with this invention includes an inner closure 18 formed by identical inner plastic sections 20 and 22, and an outer sleeve 24.

Referring specifically to FIG. 2, each of the plastic sections 20 and 22 of the inner closure 18 is of a generally C-shaped, cross-sectional configuration having a base section 25 and inturned legs 26 terminating at marginal or distal edges 28. When the sections 20 and 22 are connected together the inturned legs 26 thereof define the side walls of the inner closure 18.

Still referring to FIG. 2, a rear wall 30 in each of the sections 20 and 22 of the inner closure is provided with transversely spaced-apart fingers or ribs 32 terminating at upper edges 34 that either are located in the same plane as, or inwardly of the plane of the marginal edges 28 of the legs 26. The transversely spaced-apart fingers or ribs 32 define U-shaped recesses 36 therebetween.

A second set of transversely spaced-apart fingers or ribs 38 are spaced axially from the rear wall 30 of each of the sections 20 and 22, but are located axially inward of the front end wall 40. These fingers or ribs 38 also terminate in distal edges 42 which either are located in the same plane as, or inwardly of the plane of the marginal edges 28 of the legs 26. The transversely spaced-apart fingers or ribs 38 define U-shaped recesses 44 therebetween, and these recessess are axially aligned with the U-shaped recesses 36 adjacent the rear end wall 30 of each of the sections 20 and 22. These axially aligned recesses 36, 44 aid in properly locating and retaining the contacts 12 and 14 in proper position within the connectors, as will be explained in greater detail hereinafter.

Still referring to FIG. 2, each of the sections 20 and 22 includes a locating tab 46 integrally molded therewith adjacent one of the legs 26. These tabs extend beyond the marginal edges 28 of the legs 26 for cooperating with a mating plastic section (20 or 22) and with an electrical contact (12 or 14) in said mating plastic section, to thereby locate the sections 20 and 22 in proper orientation relative to each other, and also initially to retain said sections in a closed position to form the inner closure 18.

Referring now to FIGS. 1 and 2, each of the electrical contacts 12 and 14 includes a insulated conductive wire 50 secured thereto, and a portion of each contact, including the region thereof secured to the wire 50, is embedded in an insulating sleeve 52. An annular groove 54 is provided in each of the sleeves 52, and this groove is axially spaced from a rear edge 56 of the sleeve substantially the same distance as the axial spacing between the fingers 32 and 38 in each of the plastic sections 20 and 22. In addition, the diameter of each sleeve 52 in the region of the groove 54 is substantially the same as the transverse distance between the fingers 38, and between the locating tab 46 and its adjacent finger 38.

Referring to FIGS. 2 and 3, a row of contacts initially is positioned in each of the plastic sections 20 and 22. Thus, when the plastic sections 20 and 22 are in a closed condition the contacts in each section will be aligned with an adjacent contact in the other section. In the illustrated embodiment each row of contacts includes two male contacts 12 and one female contact 14. However, it should be understood that the number and arrangement of contacts within the connector are purely matters of design choice, and do not form any limitation on the present invention.

Still referring to FIGS. 2 and 3, the contacts 12 and 14 assembled with the plastic section 22 are inserted into the U-shape recesses 44 of said section with the annular groove 54 of the insulating sleeve 52 of each contact receiving adjacent fingers 38, and with a rear edge 56 of each insulating sleeve 52 engaging inner surfaces 58 of the fingers 32 (FIG. 3). In this regard it should be noted that the diameter of the insulating sleeve 52 in the region outside the annular groove 54 is greater than the transverse dimension of the U-shaped recesses 36, thereby permitting the rear edge 56 of each insulating sleeve to engage inner surfaces 58 of adjacent fingers 32.

The locating tab 46 of the section 22, which is shown at the upper end of FIG. 3, also is engaged within the annular groove 54 of the adjacent contact mounted in that section. Moreover, the portion of this tab extending beyond the marginal edge 28 of the section 22 extends into the region of the plastic section 20, between an inner surface of an adjacent leg 26 of said latter section and the annular groove 54 of a contact adjacent said leg 26 of said section 20. Although the manner in which the locating tab 46 of the section 22 cooperates with the section 20 and the contact therein, as described above, is not specifically shown in FIG. 3, the cooperative relationship is identical to that shown at the lower end of FIG. 3, wherein the locking tab 46 of plastic section 20 is shown in its cooperating position within the opening provided between the inner surface of leg 26 of the plastic section 22 and the annular groove 54 in the insulating sleeve 52 of the contact adjacent to said leg.

It should be understood that each locating tab 46, which is molded as a unitary part of each plastic section 20 and 22 cooperates with the other plastic section and the contacts mounted therein to properly locate the plastic sections relative to each other to form the inner closure 18. However, these locating tabs are not relied upon to maintain the plastic sections in a closed condition during use, since there is not a sufficient frictional interaction to assure that the plastic sections 20 and 22 will remain assembled with each other.

Figure 4:
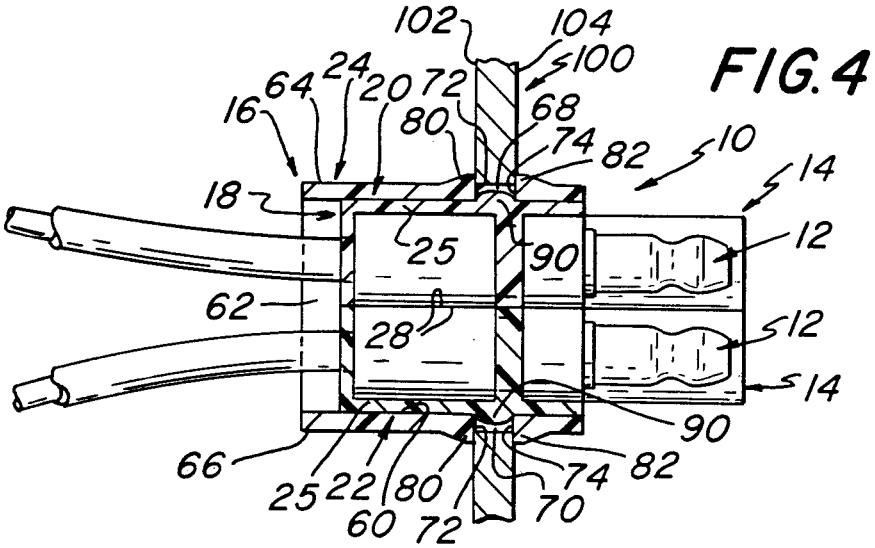
FIG. 4 is a sectional view taken along line 4—4 of FIG. 1.

Referring to FIGS. 2–4, a unique outer sleeve 24 in accordance with this invention has a substantially continuous wall with an inner surface 60 defining a generally oblong, axially extending passageway 62 therethrough. This passageway is of substantially the same shape and dimension as that defined by the outer surface of the inner closure 18, when the plastic sections 20 and 22 of said closure are connected together.

Upper and lower walls 64 and 66 of the sleeve 24 are each interrupted by a transversely extending slot 68 and 70, respectively. The axial, or narrow dimension of each of the slots 68 and 70 is defined by confronting edges or faces 72 and 74, and the transverse dimension of each of said slots is defined between transversely spaced-apart edges 76 and 78.

As can be seen best in FIGS. 2 and 4, raised ribs 80 nd 82 form unitary extensions of the outer surface 84 of the sleeve 24 adjacent each of the slots 68 and 70, and these raised ribs include confronting faces forming continuous extensions of the confronting faces 72 and 74 of each of the slots 68 and 70.

Referring specifically to FIG. 4 the base 25 of each of the sections 20 and 22 of the inner closure 18 is provided with a raised, transversely extending rib 90. Each rib has a transverse dimension which is approximately the same as, or preferably slightly less than the transverse dimension of each of the slots 68 and 70, as defined between the transversely spaced-apart edges 76 and 78.

Referring to FIGS. 1 and 4 the raised, tranversely extending ribs 90 on each of the sections 20 and 22 and the transversely extending slots 68 and 70 provide cooperating retaining means for retaining the inner closure 18 in a predetermined location within the outer sleeve 24, and for permitting the inner closure to be removed from the sleeve when it is desired to gain access to the contacts 12 and 14 of the connector. Specifically, when the outer sleeve 24 is fully inserted over the mating sections 20 and 22 of the inner closure 18 the transversely extending ribs 90 on these mating sections snap into the slots 68 and 70 to thereby properly locate the inner closure 18 relative to the outer sleeve 24. As can be seen best in FIGS. 1 and 4, the slots 68 and 70 and the ribs 90 are located so that, in assembled condition, the forward edges of the inner closure and outer sleeve are coterminous with each other. Also, as can be seen best in FIG. 4, the outer sleeve 24 has a greater axial dimension than that of the inner closure 18, and thereby extends rearwardly beyond the rear edge of the inner closure.

As can be seen best in FIGS. 1 and 4, the portion of the confronting faces 72 and 74 extending outwardly of the outer surface 84 of the sleeve 24 are locking surfaces which engage, or are closely adjacent to opposed flat surfaces 102 and 104 of a panel 100 when connector 10 is mounted to the panel. The panel is provided with a passage therethrough, into which the housing 16 of the connector is inserted, to thereby lock the panel between the confronting faces 72 and 74 of said housing.

Although the members forming the housing 16 of the connector are strong and durable, they do have a slight resilience or "give" to them, to thereby permit the connector to be disassembled from the panel 100, if desired. In addition, the plastic sections 20 and 22 forming the inner closure 18 can be snapped out of engagment with the sleeve 24, to thereby permit the plastic sections 20 and 22 to be opened for the purpose of gaining access to the contacts 12 and 14 therein, when desired.

From the above discussion it should be apparent that the multi-contact electrical connector 10 of this invention can be non-destructively disassembled for the purpose of either replacing or repairing the electrical contacts therein, and is designed for use in a variety of different environments, either attached to or separated from a panel.

Without further elaboration, the foregoing will so fully illustrate my invention that others may, by applying current or future knowledge, adopt the same for use under various conditions of service.

What is claimed as the invention is:

1. An electrical connector having a housing for a plurality of electrical contacts, characterized in that said housing includes an inner closure for receiving the electrical contacts therein and retaining said electrical contacts in proper position, and an outer sleeve for surrounding said inner closure, said inner closure including mating sections having locating means thereon for permitting the mating sections to be positioned in engagement with each other to close the inner closure in proper position for retaining the electrical contacts therebetween and for permitting said mating sections to be non-destructively separated from each other to open the inner closure and expose the electrical contacts; said outer sleeve having a peripheral wall at least a portion of which is circumferentially continuous for defining a central passageway, said inner closure, when in a closed condition, being receivable within said central passageway for retaining the inner closure in a closed condition, said inner closure being removable from said central passageway for permitting the mating sections of said inner closure to be non-destructively separated from each other to thereby open said inner closure, and cooperating retaining means on said sleeve and said inner closure for retaining said inner closure in a predetermined location within the sleeve while permitting the inner closure to be removed from the sleeve when desired.

2. The electrical connector of claim 1 wherein the outer sleeve includes spaced-apart surfaces confronting each other and defining a space between them for receiving a panel, whereby said electrical connector can be secured to a panel when desired.

3. The electrical connector of claim 1 wherein said locating means includes tab means on each mating section for cooperating with the other mating section and a contact in said other mating section for aiding in locating said mating sections in proper orientation relative to each other and to non-destructively retain said mating section in a closed position when said mating sections are in said proper orientation.

4. The electrical connector of claim 3 wherein the mating sections of said inner closure include locating and retaining members for contacts positioned therein, said locating and retaining members including transversely spaced-apart ribs defining transversely aligned recesses therebetween for receiving electrical contacts in transverse alignment with each other, said contacts including insulating sleeve members with grooves therein for receiving the ribs and the tab means therein.

5. The electrical connector of claim 1 wherein said cooperating retaining means includes a raised rib on the outer periphery of each of said mating sections of the inner closure and openings in an inner surface defining said central passageway, said openings receiving said ribs therein.

6. The electrical connector of claim 5 characterized in that said openings in the inner surface defining said central passageway extend through the walls of the sleeve.

7. The electrical connector of claim 6 characterized in that the sleeve includes two pairs of raised ribs on the outer periphery thereof, the ribs of each pair terminating in spaced-apart, confronting surfaces for receiving a panel therebetween, said confronting surfaces of each pair of ribs being disposed on opposed sides of a respective opening through the peripheral wall of said sleeve.

8. The electrical connector of claim 7 characterized in that the confronting surfaces of each pair of ribs are continuous extensions of surfaces defining a respective opening through the peripheral wall of the sleeve.

* * * * *